United States Patent [19]

Pickles

[11] Patent Number: 4,592,245

[45] Date of Patent: Jun. 3, 1986

[54] WINDOW REGULATOR HAVING C-SHAPED GUIDE AND FLEXIBLE TAPE WITH RACK TEETH

[75] Inventor: Joseph Pickles, Birmingham, Mich.

[73] Assignee: Ferro Manufacturing Corporation, Southfield, Mich.

[21] Appl. No.: 517,979

[22] Filed: Jul. 28, 1983

[51] Int. Cl.[4] ..... E05F 11/48

[52] U.S. Cl. ..... 74/89.21; 49/352

[58] Field of Search ..... 74/89.2, 89.21, 89.22; 49/348, 349, 352

[56] References Cited

U.S. PATENT DOCUMENTS

| | | | |
|---|---|---|---|
| 4,004,371 | 1/1977 | Podolan et al. | 49/352 |
| 4,110,935 | 9/1978 | Sessa | 49/352 |
| 4,168,595 | 9/1979 | Pickles et al. | 49/352 |
| 4,222,202 | 9/1980 | Pigeon | 49/352 |
| 4,229,906 | 10/1980 | Pickles | 74/89.2 X |
| 4,235,117 | 11/1980 | Pickles | 74/89.2 |
| 4,237,657 | 12/1980 | Kazewych | 49/352 |
| 4,335,541 | 6/1982 | Kazewych | 49/352 X |
| 4,364,202 | 12/1982 | Zavatkay | 49/352 |
| 4,400,913 | 8/1983 | Krantz et al. | 49/352 |
| 4,433,509 | 2/1984 | Seppala | 49/352 |

FOREIGN PATENT DOCUMENTS

| | | | |
|---|---|---|---|
| 556132 | 4/1957 | Belgium | 74/89.22 |
| 2532458 | 2/1977 | Fed. Rep. of Germany | 49/352 |
| 2635897 | 2/1978 | Fed. Rep. of Germany | 49/349 |
| 1027940 | 4/1966 | United Kingdom | 49/352 |

*Primary Examiner*—William L. Freeh
*Assistant Examiner*—Paul F. Neils
*Attorney, Agent, or Firm*—Stephenson and Boller

[57] ABSTRACT

A window regulator comprises a stiff but bendable elongated guide of general C-shape having inturned retainer flanges, and a flexible tape of a cross-section conforming to the interior of said guide, and slidably retained therein by the flanges. The bottom wall of the guide preferably has a channel therein contributing to its stiffness and providing spaces for fasteners for installing the guide or mounting structure thereon. The portion of the tape exposed between the edges of the flanges is formed with rack teeth for driven engagement with a drive pinion preferably mounted on the guide. A housing for the drive pinion has a connector for connecting to one end of the tape, and the end portion of the tape beyond the guide is thus formed into an expandable loop. In order to avoid subjecting the guide to large stresses due to tape tension, a relatively large gear carried by the guide engages the tape at a major bend of the guide. A spring is connected to the gear to act in window-raising direction. The major bend in the guide where the vertical window actuating portion connects the angularly disposed drive portion has hinged parts supporting the gear and providing for parallel positioning of the guide legs for insertion through a small opening in the door.

5 Claims, 8 Drawing Figures

WINDOW REGULATOR HAVING C-SHAPED GUIDE AND FLEXIBLE TAPE WITH RACK TEETH

BRIEF SUMMARY OF THE INVENTION

Window regulators in which an elongated flexible motion transmitting member is slidable longitudinally along an operationally rigid but bendable guide are well known.

The present invention represents an improvement over applicant's prior U.S. Pat. Nos. 4,168,595, 4,229,906 and 4,235,117.

The improved window regulator comprises essentially an elongated thin, flat flexible tape slidable longitudinally in a general C-shaped, elongated, operationally rigid but bendable guide having spaced apart inwardly extending retainer flanges at its edges. The tape has a series of rack teeth exposed by the space between the inner edges of the flanges.

A drive pinion, which may be mounted directly on the guide, engages the rack teeth. One end of the tape has means movable along the space between the inner edges of the retainer flanges for attachment to a vehicle window, which is raised or lowered by rotation of the pinion. Thus the tape acts in tension and compression, which latter is permitted by the action of the guide in which the tape is slidable.

Preferably the inner wall of the guide has an inwardly facing channel which contributes to the stiffness of the guide and also provides for attachment devices such as screws without interfering with the tape. In addition, by reducing area contact with a flat side of the tape, friction opposing sliding of the tape is reduced.

The guide may be formed from metal strip, and the tape from a suitable resin, such for example, as nylon 101.

In one embodiment of the invention, the guide is bent to have a vertical leg connected to a leg inclined downwardly from the horizontal by an arcuate bend of substantial radius of curvature. At the inside of this bend there is provided a support gear having teeth conjugate to the rack teeth on the tape. The support gear, when the tape is lifting the window, is acted on by forces applied by the tension in both legs of the guide. By mounting the support gear on a bracket attached to the back of the guide, forces developed by tension in the tape are removed from the retainer flanges.

The drive pinion is preferably in a housing mounted at the free end of the inclined (non-vertical) leg of the guide and includes means for attaching the free end of the tape to the housing. With this arrangement the tape, as it emerges from the end of the guide, is formed into a bow or loop, which, because it is flexible only in the plane perpendicular to its width, conforms itself to the space within the vehicle door.

The support gear is preferably connected to one end of a coil spring, the other end of which is fixed to the guide. The spring is mounted to bias the gear for rotation in the direction to raise the window, and thus counter balances a portion of its weight.

A further feature of this embodiment of the invention is the provision of a hinge structure interconnecting the two legs of the guide which permit them to be moved into parallelism for insertion in a small opening in the vehicle door or body part in which the window regulator is mounted. The hinge parts are mounted for hinged movement about the axis of the support gear, which is pivoted to the hinge.

DETAILED DESCRIPTION

Figure 1:
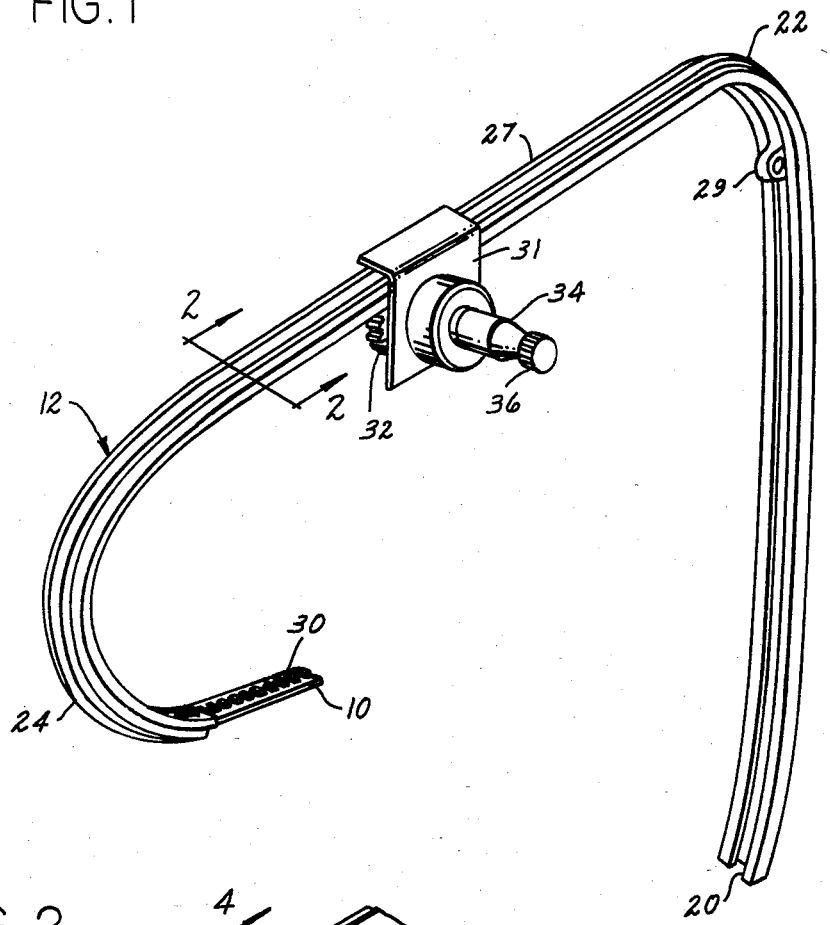
FIG. 1 is a perspective view of the window regulator.
Figure 2:
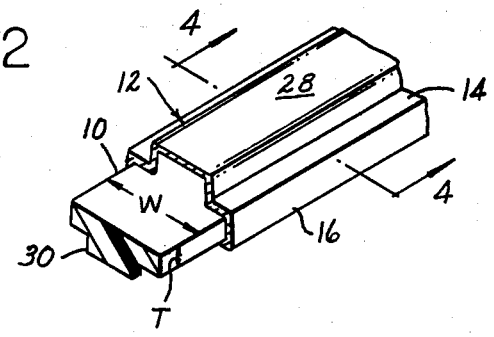
FIG. 2 is an enlarged fragmentary, partly sectioned perspective view of the regulator.
Figure 3:
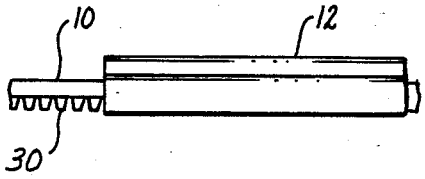
FIG. 3 is a fragmentary side view of the regulator.
Figure 4:
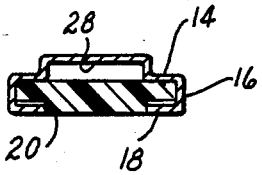
FIG. 4 is a sectional view on the line 4—4, FIG. 2.

The window regulator comprises an elongated flat flexible tape 10 having a width W much greater than its thickness T. The tape is formed of a flexible plastic resin such, for example, as nylon 101. As a result of its width to thickness ratio, its flexibility is limited essentially to a longitudinal plane perpendicular to its width. It is dimensioned such that it is capable of acting in tension to raise a vehicle window and in compression to lower the window against frictional restraint.

Since the tape is flexible, it requires a functionally rigid guide to constrain it against flexing when subjected to longitudinal compression forces. The guide 12 is formed of metal strip bent to the illustrated configuration, which is of generally C-shaped cross-section with an inner wall 14 and side walls 16 provided at their outer edges with inwardly extending retainer flanges 18, the confronting edges of which are spaced to define a continuous opening or slot 20 through which the tape is exposed.

The guide is operationally rigid in the sense that forces applied to the tape received in the guide are effective only to slide the tape longitudinally in the guide. It is, however, bendable and may be bent into the curved segments illustrated at 22 and 24. The curved segment 22 connects straight vertical leg 26 to straight downwardly inclined leg 27. When so bent, it will retain the shape it assumes in the bending operation. In the embodiment illustrated in FIG. 1, curved guide portion 24 is at one end of guide leg 27, so that as the window is raised, the end portion of the flexible tape is for the most part received in arcuate guide portion 24.

The bottom wall 14 of the guide is formed to provide an inwardly facing channel 28 which contributes to the operational rigidity of the guide as well as serving as means for mounting the guide or for attaching other structure thereto. In addition, it reduces area contact with the smooth inner side of the tape, thus reducing frictional resistance to longitudinal sliding of the tape.

The portion of the tape 10 which is exposed by the guide slot 20 is provided with a series of rack teeth 30 which are effective to drive the tape longitudinally without materially affecting its flexibility in the plane of bending, but, of course, increases its resistance to bending in a plane perpendicular thereto.

The ends of teeth 30 are spaced from the edges of the tape, leaving smooth edge portions cooperating with the retainer flanges.

The free end portion of the tape movable vertically in leg 26 of the guide is provided with a lug 29 for attachment to the lower edge of the vehicle window.

Mounted on the guide is a bracket 31 which carries pinion 32 in mesh with the teeth 30. As seen in FIG. 1, pinion 32 is driven by shaft 34 which has a serrated end 36 to which a manually operated crank may be engaged. Alternately, of course, shaft 34 may be power driven by an electric motor.

Figure 5:
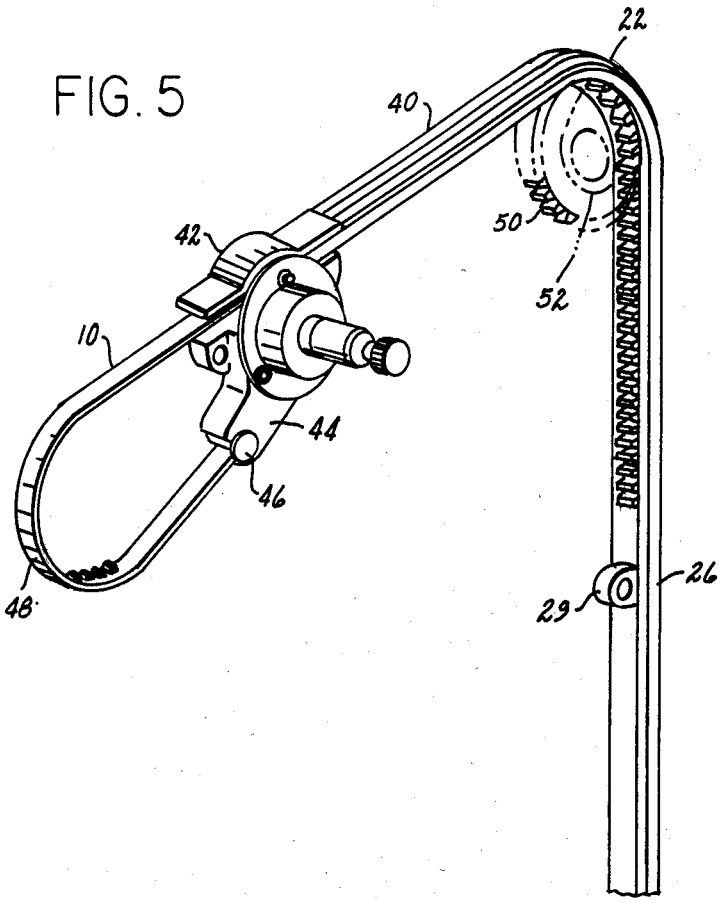
FIG. 5 is a perspective view of a different embodiment of the invention.

Referring now to FIG. 5, a leg 40 of the guide may be straight, omitting the bend 24 shown in FIG. 1. In this case fixture 42 is mounted on the free end of leg 40 so that as it emerges from the free end of the guide, the tape is unsupported, providing for a substantial reduction in the length of guide shown in FIG. 1.

In this embodiment of the invention, fixture 42 includes an arm 44 to which one end of tape 10 is attached, as by a pivot pin 46, so that as the tape emerges from the guide leg 40, it forms a loop 48. Since flexibility of the tape is limited to the plane perpendicular to its width dimension, the loop controls itself to occupy such plane and expands and contacts within the door or frame cavity. The formation of the loop further results in compactness of the installation.

It will be understood that when the tape as seen in FIGS. 1 and 5 is operated to raise the window to which it is connected, the portions of the tape within vertical leg 26 and angularly related leg 27 or 40 are in tension, and the forces at the bend 22 acting against the retainer flanges 18 represent the vectored sum of the tape tension. Since the retainer flanges are unsupported at their free edges, excessive tension might bend these flanges. Accordingly, a gear 50, conjugate to the rack on the tape 10 is supported on a bracket, a portion of which is seen at 52. The bracket is attached to the guide 12 adjacent the bend 22 as by bolting or otherwise attaching it to the outer surface of the bottom wall of channel 28. Therefore, the retainer flanges at the bend are relieved from excessive forces when the tape in legs 27 and 40 is tensioned.

Figure 6:
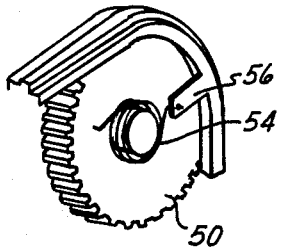
FIG. 6 is a detail in perspective of the regulator shown in FIG. 5.

In FIG. 6 a coil counterbalance spring 54 is shown as connected at one end to the gear 50 and at the other end to an arm 56 on the guide, or preferably on the bracket 52. The spring is tensioned to bias the gear counterclockwise as seen in FIG. 6, so as to assist in counterbalancing the weight of the window.

Figure 7:
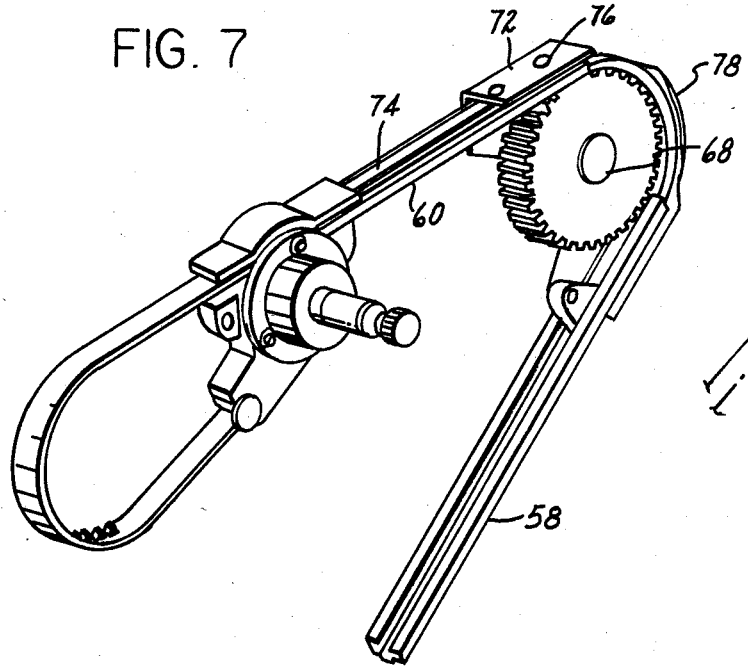
FIG. 7 is a perspective view of a further embodiment of the invention.
Figure 8:
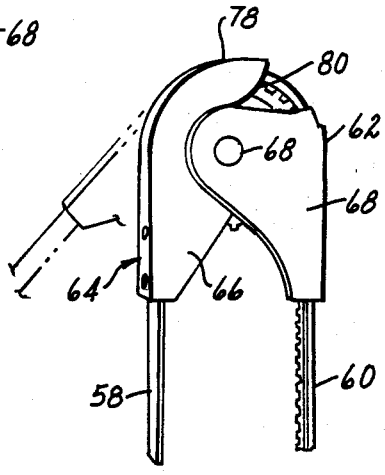
FIG. 8 is a fragmentary elevational view of the hinge structure of FIG. 7.

A further improvement is illustrated in FIGS. 7 and 8, it sometimes is necessary to insert or remove the window regulating mechanism through an opening in a door panel or the like, and for this reason, normally vertical leg, here shown at 58 is hinged to the straight, normally slightly downwardly inclined leg, here seen at 60.

The hinge parts 62, 64 as best seen in FIG. 8, include side plates 64, 66 which mount pivot pin 68 on which support gear 70 is rotatable. Hinge part 62 includes plate 72 which may be riveted or otherwise attached to the outer surface of guide channel 74 as seen at 76. The other hinge part is similarly mounted on the other guide leg. Hinge part 64 includes arcuate cover portion 78, the end of which is separated from a straight cover portion on hinge part 62 when the legs are parallel. The separation is well illustrated at 80 in FIG. 8, where a portion of the tape is seen. When the guide legs are spread apart to operating position, gap 80 is closed and the hinge parts function as part of the tape guide structure.

I claim:

1. Apparatus for converting rotary motion to linear motion comprising an elongated relatively thin flat tape having at one side a series of transversely extending rack teeth terminating short of the edges of the tape to leave smooth guide surfaces, an elongated operationally rigid but bendable guide of generally C-shaped cross-section having a bottom and side walls, in-turned spaced apart retainer flanges at the edges of said side walls engageable with the smooth guide surfaces at the edges of the tape and defining a longitudinally extending opening at which the rack teeth of said tape are exposed, a bracket secured to said guide, a drive pinion carried by said bracket in mesh with said rack teeth, a connector on said tape movable along said opening as said tape is moved longitudinally in said guide, in which said apparatus is a window regulator for raising and lowering the window of a motor vehicle, said guide comprising a substantially vertical lift portion and an angularly disposed drive portion on which said pinion bracket is mounted, said guide portions being interconnected by arcuate guide means comprising hinge structure of two parts, each part being secured to a different one of said guide portions to provide for bringing the guide portions into substantial parallelism.

2. Apparatus as defined in claim 1, in which a support gear is pivotally secured to said hinge parts and is in mesh with the rack teeth of the tape thereat.

3. Apparatus as defined in claim 1, said hinge parts including tape cover portions abutting when said guide portions are disposed in operating position.

4. Apparatus as defined in claim 3, in which a guide gear is pivotally secured to said hinge parts for rotation about the hinge axis.

5. A window regulator for raising and lowering the window of a motor vehicle comprising an elongated flexible drive member consisting of a relatively thin flat tape having at one side a series of transversely extending rack teeth, guide structure for said drive member comprising a pair of operationally rigid elongated guide portions, hinge means interconnecting adjacent ends of said elongated guide portions, said guide structure and said drive member having cooperating guide surfaces providing for only relative sliding movement between said guide structure and said drive member longitudinally of said member to enable said member to operate in tension and compression, rotary drive means engageable with side member at a portion thereof supported by said guide structure operable to move said drive member along said guide structure in either direction, said hinge means comprising a pair of pivotally interconnected hinge parts including an arcuate guide portion, a support gear having teeth arranged in meshing engagement with said rack teeth, said gear being carried by said hinge means and having its axis of rotation at the center of curvature of said arcuate guide portion and at the pivot axis between said hinge parts, said support gear having its periphery in supporting engagement with said flexible drive member as it tranverses said arcuate guide portion.

* * * * *

UNITED STATES PATENT AND TRADEMARK OFFICE

CERTIFICATE OF CORRECTION

PATENT NO. : 4,592,245

DATED : June 3, 1986

INVENTOR(S) : Joseph Pickles

It is certified that error appears in the above-identified patent and that said Letters Patent is hereby corrected as shown below:

Column 4, line 61, cancel "tranverses" and insert --traverses--.

Signed and Sealed this

*Twelfth* Day of *August 1986*

[SEAL]

*Attest:*

DONALD J. QUIGG

*Attesting Officer*

*Commissioner of Patents and Trademarks*